United States Patent [19]

Gazzarrini

[11] Patent Number: 4,549,493

[45] Date of Patent: Oct. 29, 1985

[54] METHOD AND APPARATUS FOR APPLYING A GUSSET TO MANUFACTURED GOODS

[75] Inventor: Vinicio Gazzarrini, Florence, Italy

[73] Assignee: Solis, S.r.l., Florence, Italy

[21] Appl. No.: 107,426

[22] Filed: Dec. 26, 1979

[30] Foreign Application Priority Data

Jan. 9, 1979 [IT] Italy ..... 9311 A/79

[51] Int. Cl.[4] ..... D05B 21/00

[52] U.S. Cl. ..... 112/121.15; 112/262.1

[58] Field of Search ..... 112/121.15, 121.11, 112/121.12, 2, 262.2, 262.1

[56] References Cited

U.S. PATENT DOCUMENTS 4,188,898 2/1980 Bell, Jr. et al. ..... 112/121.15
4,220,104 9/1980 Humphreys ..... 112/262.1
4,224,885 9/1980 Takatori ..... 112/121.15
4,321,881 3/1982 Humphreys ..... 112/262.2

FOREIGN PATENT DOCUMENTS 462086 4/1978 Spain ..... 112/121.15

*Primary Examiner*—H. Hampton Hunter
*Attorney, Agent, or Firm*—McAulay, Fields, Fisher, Goldstein & Nissen

[57] ABSTRACT

Apparatus for applying a gusset to tubular articles such as panty hose which includes a carrousel structure carrying hollow support members across which the panty hose is stretched, operating stations for inverting the panty hose and drawing the legs inwardly of the hollow support member, apparatus applying the gusset to the panty hose, excess fabric remover, a sewing device for sewing the gusset to the panty hose, and a panty hose reversing mechanism.

28 Claims, 13 Drawing Figures

METHOD AND APPARATUS FOR APPLYING A GUSSET TO MANUFACTURED GOODS

This invention relates to applying gussets to pantyhose. More specifically, this invention relates to applying gussets to pantyhose formed as a single unit without a seam in the crotch, and provides a reinforcing gusset for the seamles crotch zone.

At present it is known to form women's pantyhose with a gusset or reinforcing member by joining two separately made tubular shaped legs by sewing. Coincident with the sewing of the two leg portions together, a reinforcing gusset, which overlaps the edges of the leg portions, is sewn thereon.

The object of the present invention is to provide a method for applying a gusset to tubular articles in general such as women's pantyhose, and a machine for carrying out the method.

According to the invention, these results have been achieved by adopting the idea of utilizing a tubular article, made separately by known means, formed by a pantyhose without gusset and lacking the seam at the crotch; stretching the edge of the seamless zone of said article according to the form of the patch to be applied; placing thereon a gusset of a form and dimensions adapted to cover the zone free of fabric of said stretched article; (and) removing the ready-made article with the gusset.

BRIEF DESCRIPTION OF THE INVENTION

Advantages and characteristics of the invention will be better understood by any technician in the field from the description which follows and from the annexed drawings, which show a schematic exemplification of a machine according to the present invention and where:

DESCRIPTION OF PREFERRED EMBODIMENT

Reduced to its essential structure, the method for applying a gusset, e.g. a circular one, to tubular articles and in particular women's pantyhose (FIG. 11–13) according to the present invention, includes: (a) stretching and fastening by hand the edge of the seamless crotch zone of a pantyhose, made separately by known means, on the horizontal edge of a support in the form of an inverted funnel so that the article is in a hanging position relative to the support; (b) pneumatically turning the body of the article over and introducing therein the legs thereof so that the edge of the fabric on which the gusset must be applied is ready for sewing; (c) mechanically placing a gusset, e.g. a circular one (FIG. 13), on a horizontal circular support plate; (d) mechanically laying said plate with the gusset thereon on the aforesaid funnel-shaped support so that the edge of the gusset is pressed and held fixed in juxtaposition to the stretched edge of the seamless zone of the article; (e) trimming the excess fabric beyond the seam line, of the article and of the gusset, simultaneously; (f) sewing the gusset to the article along the superposed edges; (g) pneumatically turning the ready-made article with patch right side out again and removing it from the support.

Figure 11:
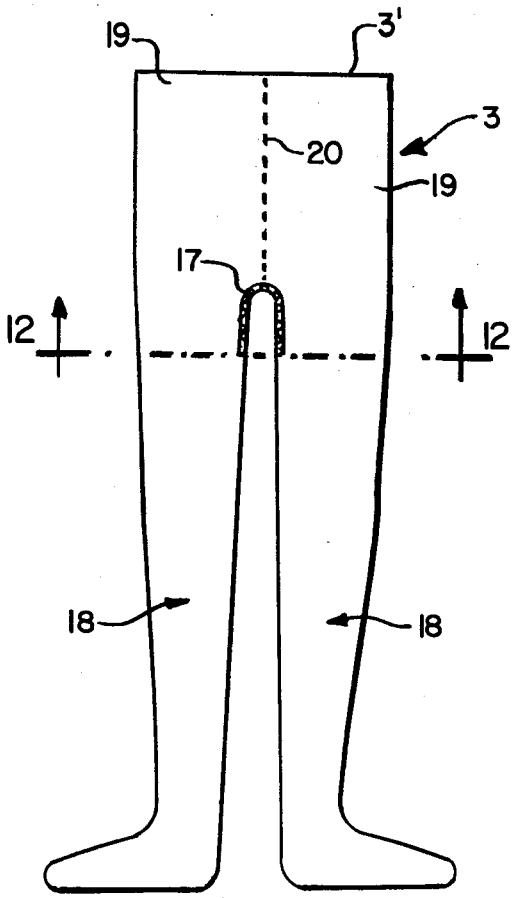
FIG. 11 is a front elevational view of a completed pantyhose article formed by the present invention.
Figure 12:
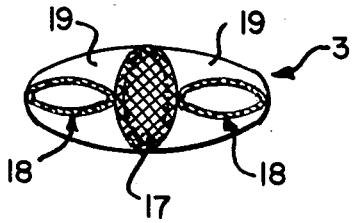
FIG. 12 is a sectional view of FIG. 11 taken through line 12—12 of FIG. 11.
Figure 13:
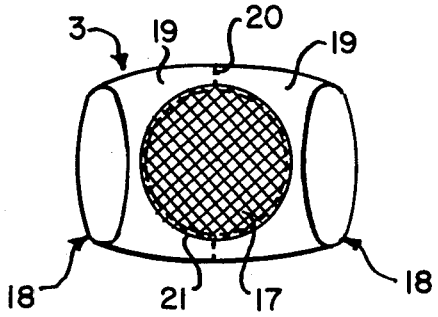
FIG. 13 is a view similar to FIG. 12 showing the pantyhose article stretched to illustrate the flattened shape of a gusset.

For a better understanding of the method, reference is made to FIGS. 11–13 which illustrate a completed pantyhose article 3 of the type discussed above, which the present invention is intended to complete automatically. As illustrated in FIGS. 11–13, the premade pantyhose article formed by known means of two identical tubular halves 18, 18 having upper body portion 19, 19 sewn together at seam 20 is provided with a gusset 17 over the stretched out portion or seamless zone 21. When the two tubular halves 18, 18 are sewn together without a gusset, the interconnection of pantyhose halves 18, 18 is subject to tearing in the crotch region. Therefore, gusset 17 spans zone 21 to remove the tension which each pantyhose half 18, 18 subjects to the other upon being sewn directly together. Gusset 17 covers zone 21 and is sewn thereover by the present invention machine so that the two halves 18, 18 are not sewn directly together.

As to the machine for carrying out said method in accordance with the invention and with reference to the attached drawings showing FIGS. 1–10, it comprises, essentially: A six-armed carrousel type structure (1) intermittently rotating horizontally, with stops at each of the six stations, which are, respectively: One (A) for laying the article while the edge of the seamless zone is being stretched; one (B) for pneumatically turning the article over; one (C) for laying the gusset with its edge superposed on the stretched edge of the article; one (D) for trimming excess portions of fabric of the article and of the gusset, beyond the seam line; one (E) for sewing the gusset to the article; one (F) for pneumatically turning the ready-made article with the gusset right side out again and discharging it.

More particularly, at the free end of each arm (1) a support (2) in the form of an inverted funnel is provided, having the function of retaining a pantyhose (3) and stretching the seamless zone of the crotch, a known means (4) being provided for setting said support (2) in horizontal rotation in the cutting and sewing stations. Above said support (2) are a cylindrical guiding chamber (5) and a jacket 6 such as to permit the possibly elastic edge (3') of the body of the pantyhose (3) to turn over completely and to permit the pantyhose legs to slip into the body with the toe up due to the suction produced inside a tubing (7) connected to the upper end of said jacket (6), the article thus positioned presenting on the outer conical surface of the support (2) the edge of the crotch zone ready to have a gusset sewn to it. Above the jacket (6), in addition to the connection of the suction tubing (7), there is provided a horizontally traversing stop device (8), having the function of retaining the free ends of the article after they have been sucked at (7) so that the article does not fall back through the funnel-shaped support (2) when the suction at (7) ceases, known means being provided for the forward and backward movement of said stop device (8).

In addition, the wall of the jacket (6) is provided with several holes (9) with respective obturating devices, the holes being intended to be open in station (F) during the phase of turning right side out and discharge of the finished article; cooperating to this end is a series of compressed air cocks (10) disposed on a cylindrical collector at the top of the aforesaid chamber (5) and inclined downward and into the chamber (5).

Below each above described support (2) is provided a circular, horizontal plate (11), traversing vertically and horizontally, having the function of supporting a gusset (12) of fabric identical with or different from that of the article, placed thereon by known means (13), and of pressing it against the edge of said support (2) with interposition of the fabric of the article to which it is to be sewn, known means being provided for the vertical displacement of the plate (11) against the support (2) and for the horizontal radial movement toward the center of the carrousel so as to free the zone under the support (2) to enable the operator to load the article on said support (2) in station (A) (FIG. 3) and to make possible in station (F) (FIGS. 8–10) the presence of a suction duct (14) under support (2) intended to transfer the completed article with the patch.

At the cutting station (D) (FIG. 6) known means (15) are provided, disposed on the exterior of the carrousel, for trimming the excess parts of fabric beyond the seam line during one complete revolution of the support (2) and also to cause said cutting means (15) to move toward and away from the support (2).

At the sewing station (E) (FIG. 7) a sewing machine (16) of known type is provided to carry out the sewing of the superposed edges of the patch and of the article during one complete revolution of the support (2), and also known means are provided for causing said sewing machine (16) to move toward and away from said support (2).

At the station (F) (FIGS. 8–10) for discharging the finished article, known means are provided for opening the holes (9) of the jacket (6), to activate the compressed air cocks (10) and to inactivate the stop device (8).

Figure 1:
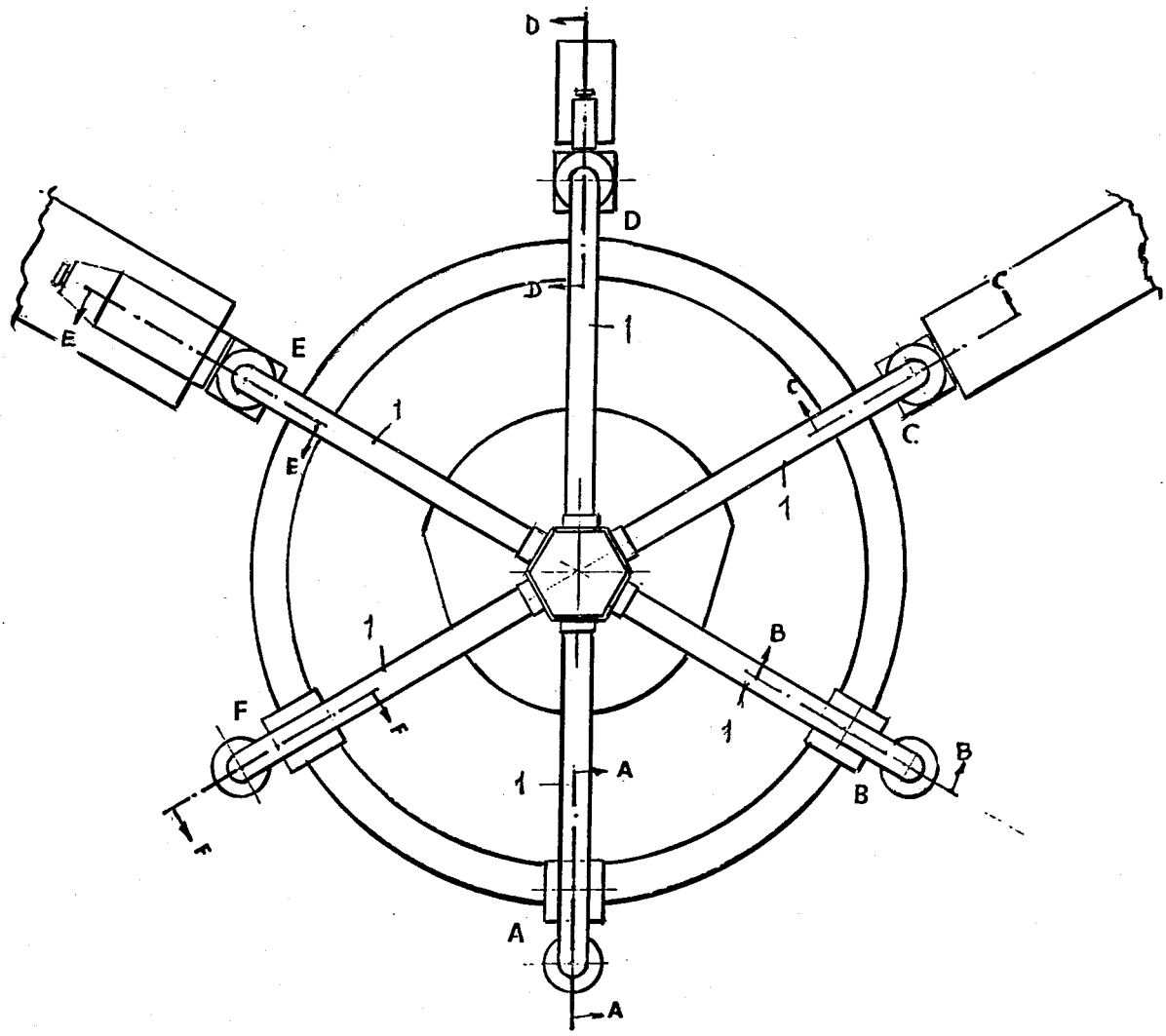
FIG. 1 is a schematic top plan view of a machine with several stations, according to the invention.
Figure 2:
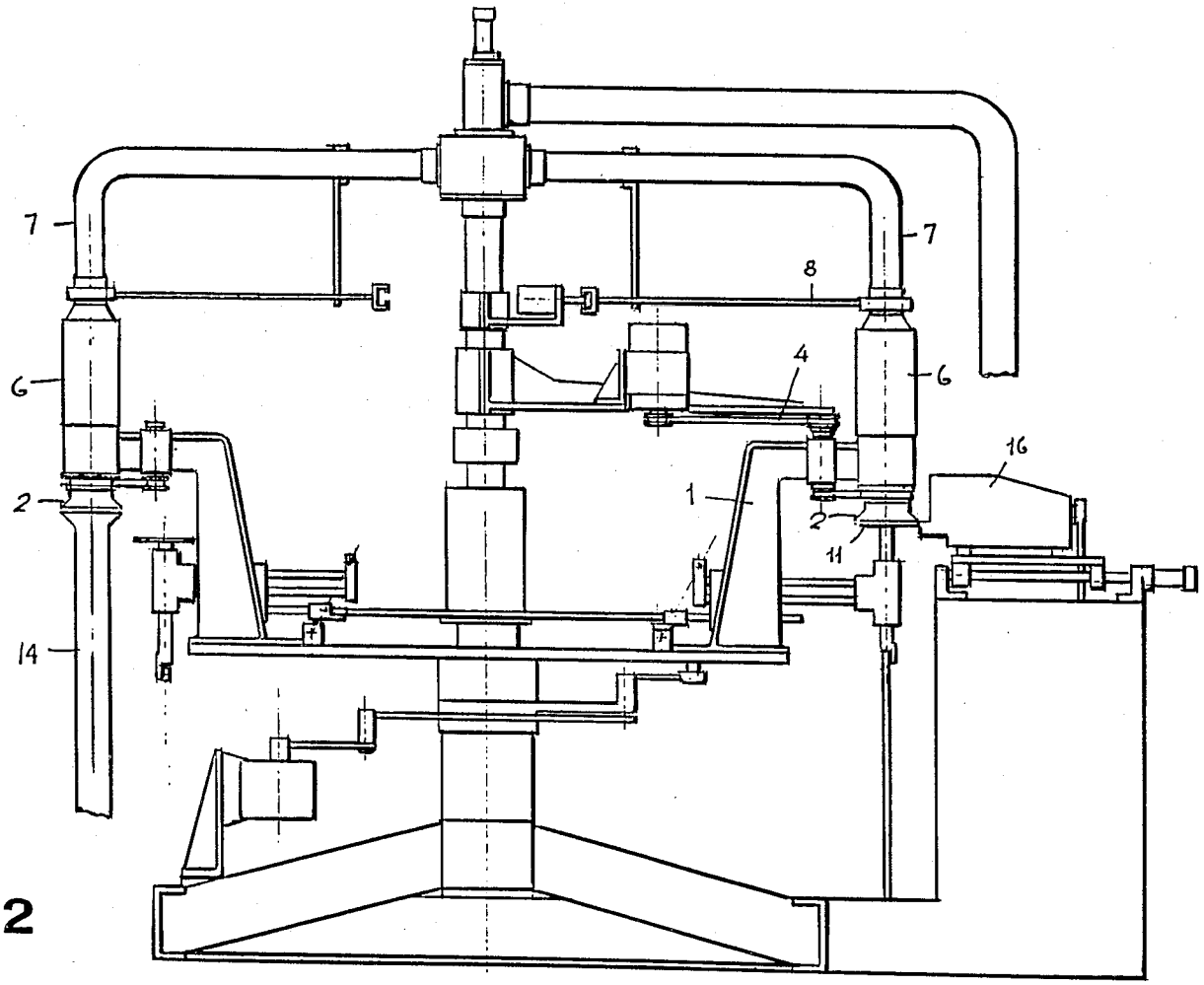
FIG. 2 is an elevational view of said machine.
Figure 4:
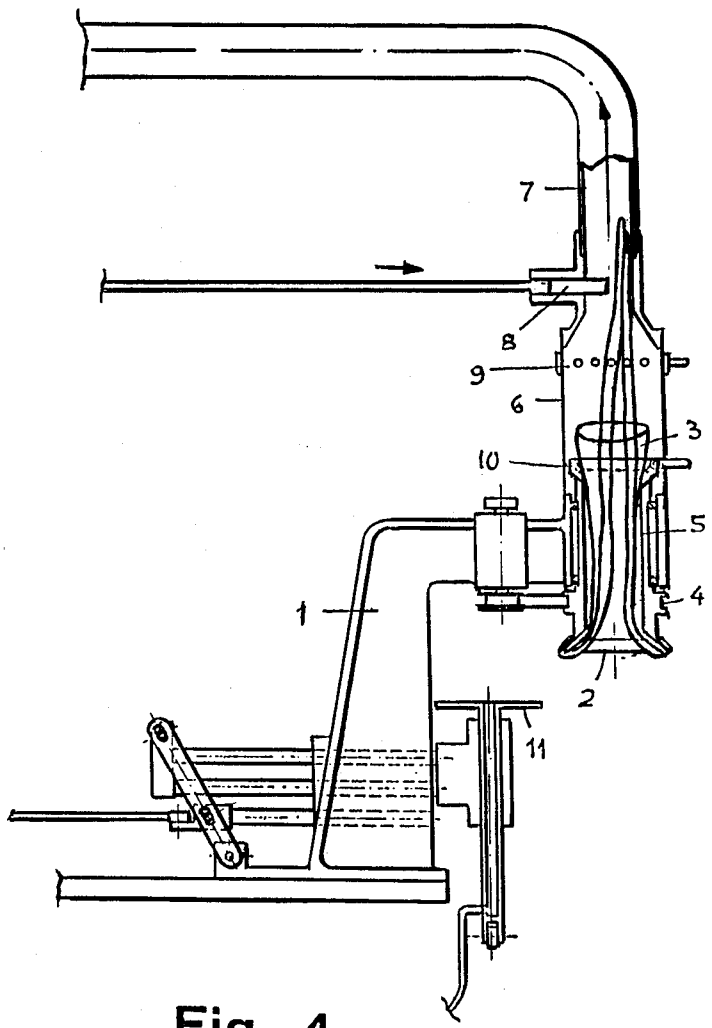
FIG. 4 is a section along BB of FIG. 1 showing the article in the arrangement of reversed positioning.
Figure 3:
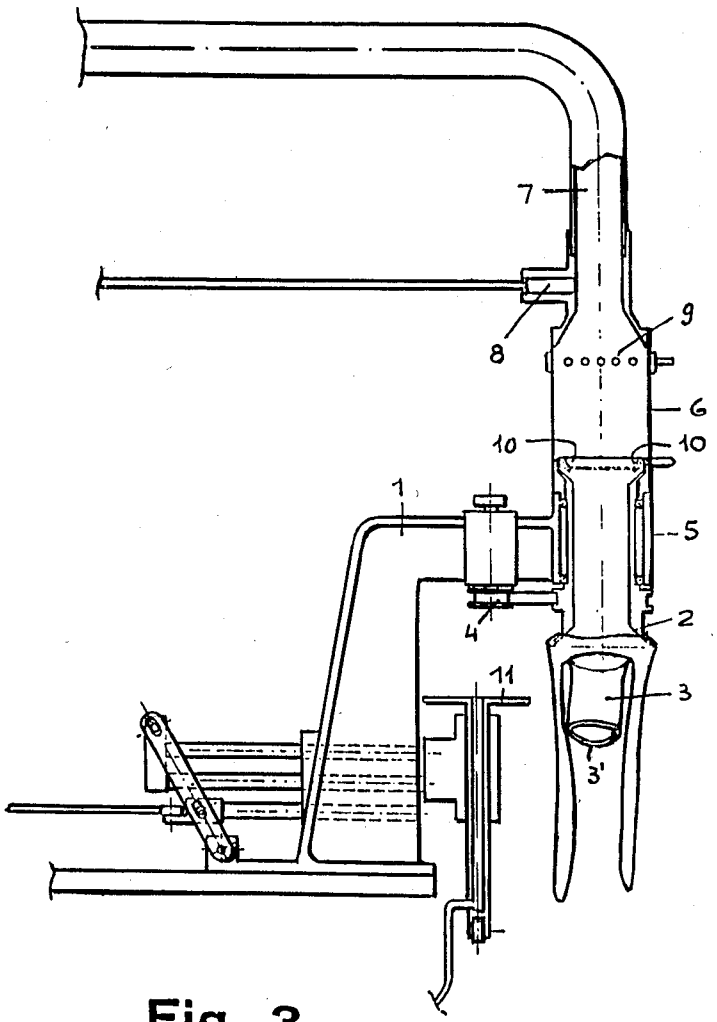
FIG. 3 is a section along AA of FIG. 1 showing the article in the arrangement of initial positioning.
Figure 6:
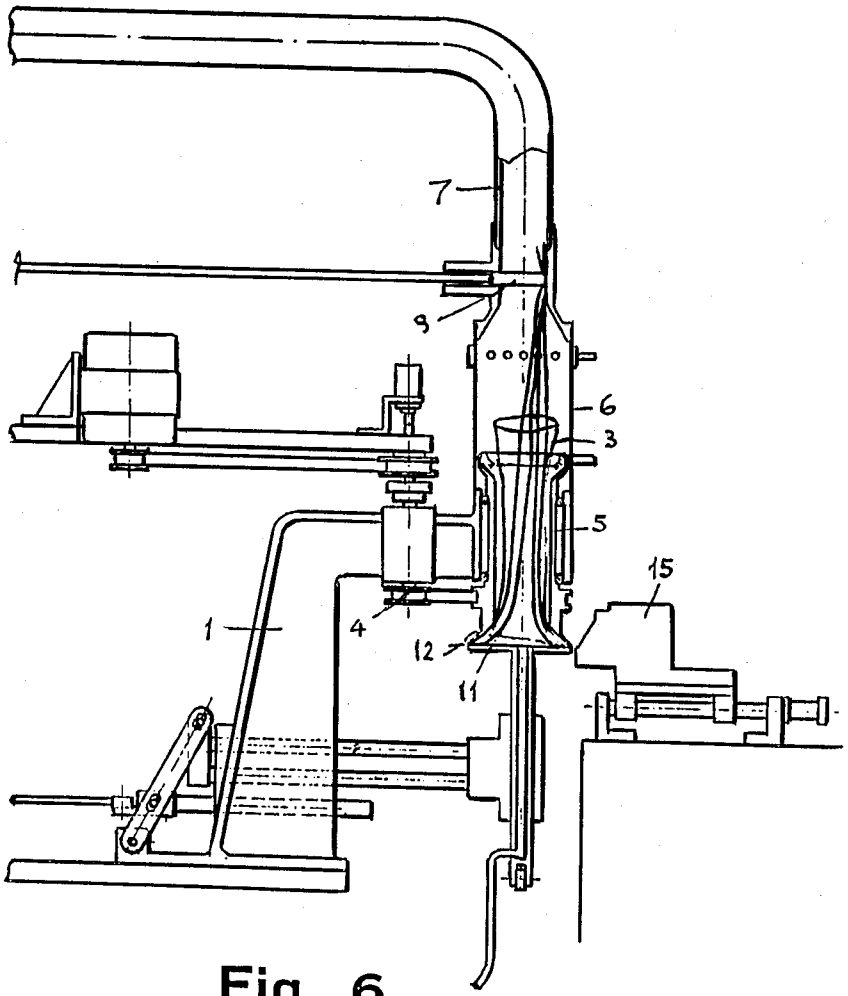
FIG. 6 is a section along DD of FIG. 1 showing the article in the position of trimming the excess fabric of the gusset and of the article.
Figure 5:
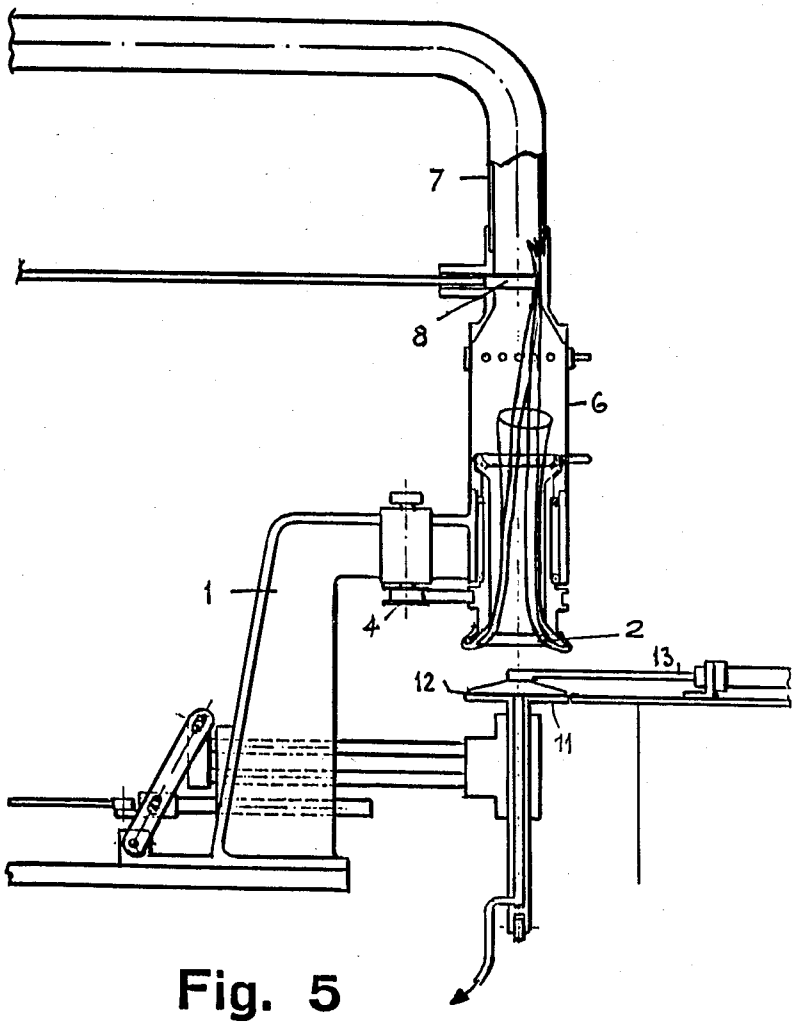
FIG. 5 is a section along CC of FIG. 1 showing the placing on of the gusset.
Figure 8:
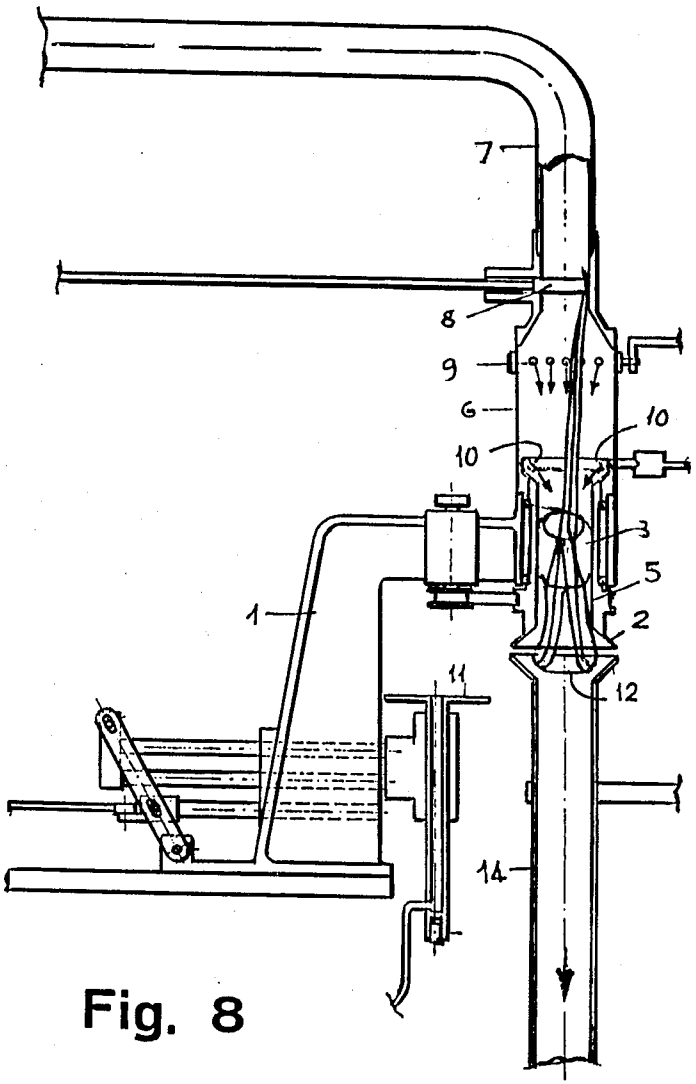
FIG. 8 is a section along FF of FIG. 1 showing the finished article detached from the support (2)
Figure 7:
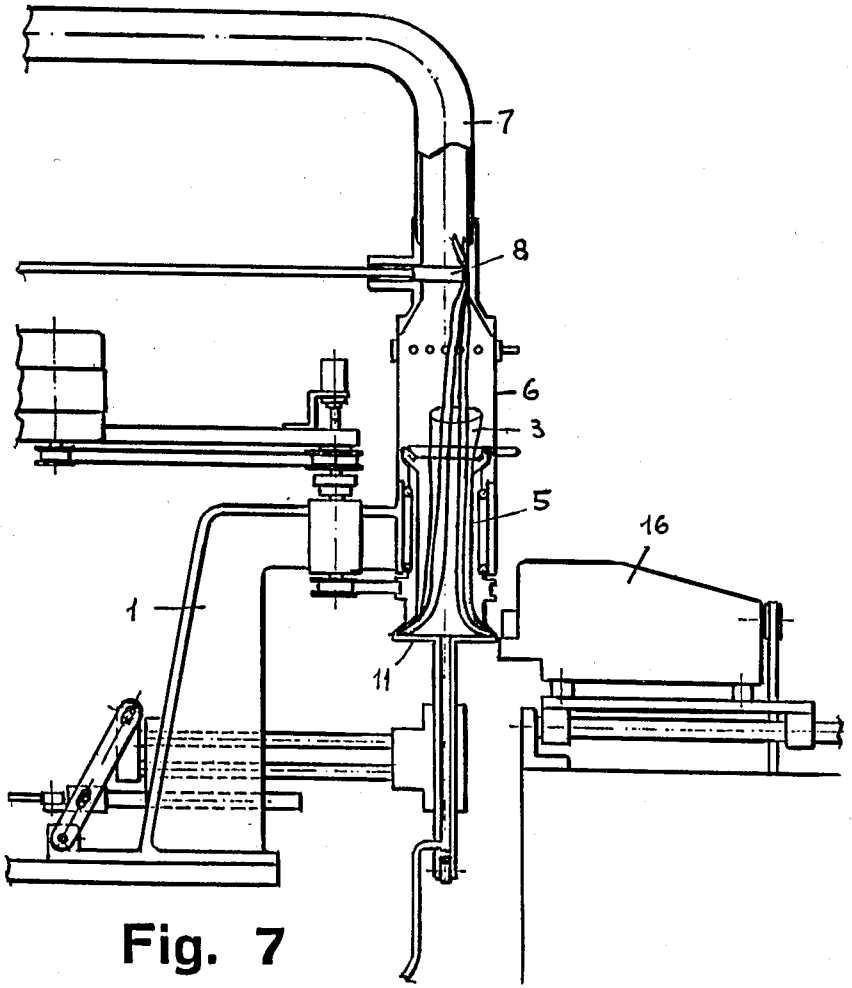
FIG. 7 is a section along EE of FIG. 1 showing the article sewing the gusset.
Figure 10:
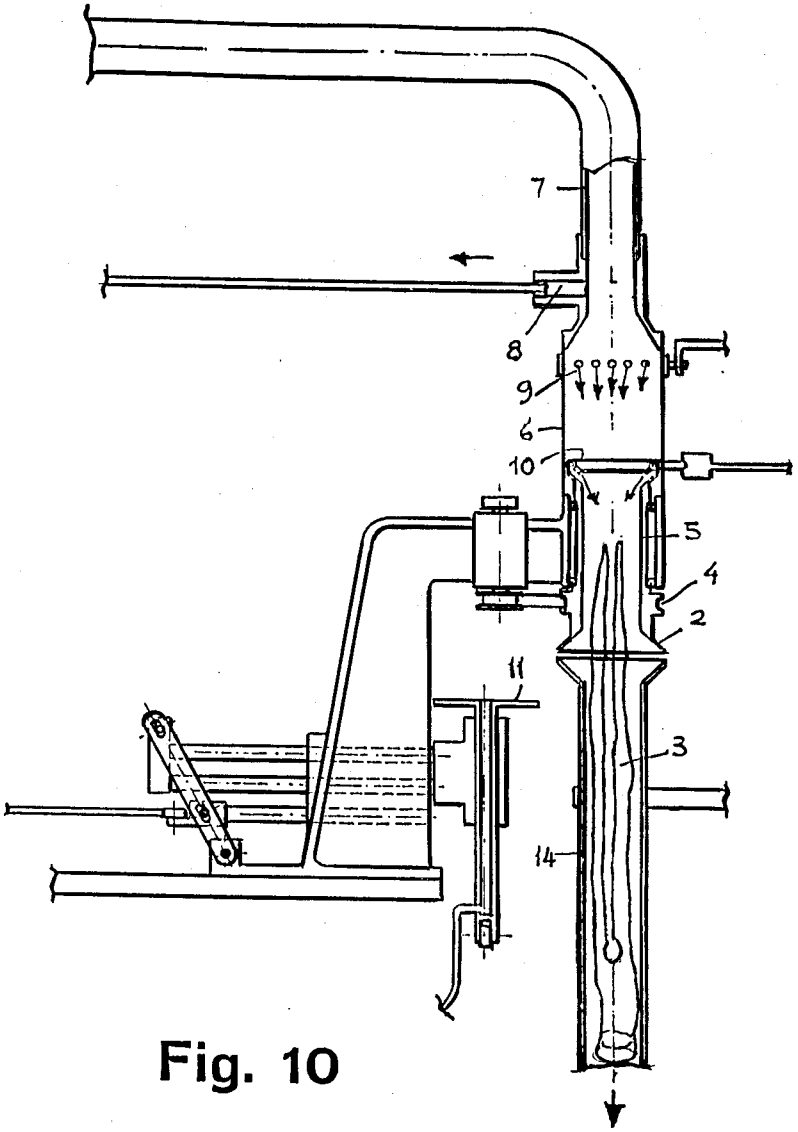
FIG. 10 represents the section along FF of FIG. 1 showing the finished article as it is being removed from the machine.
Figure 9:
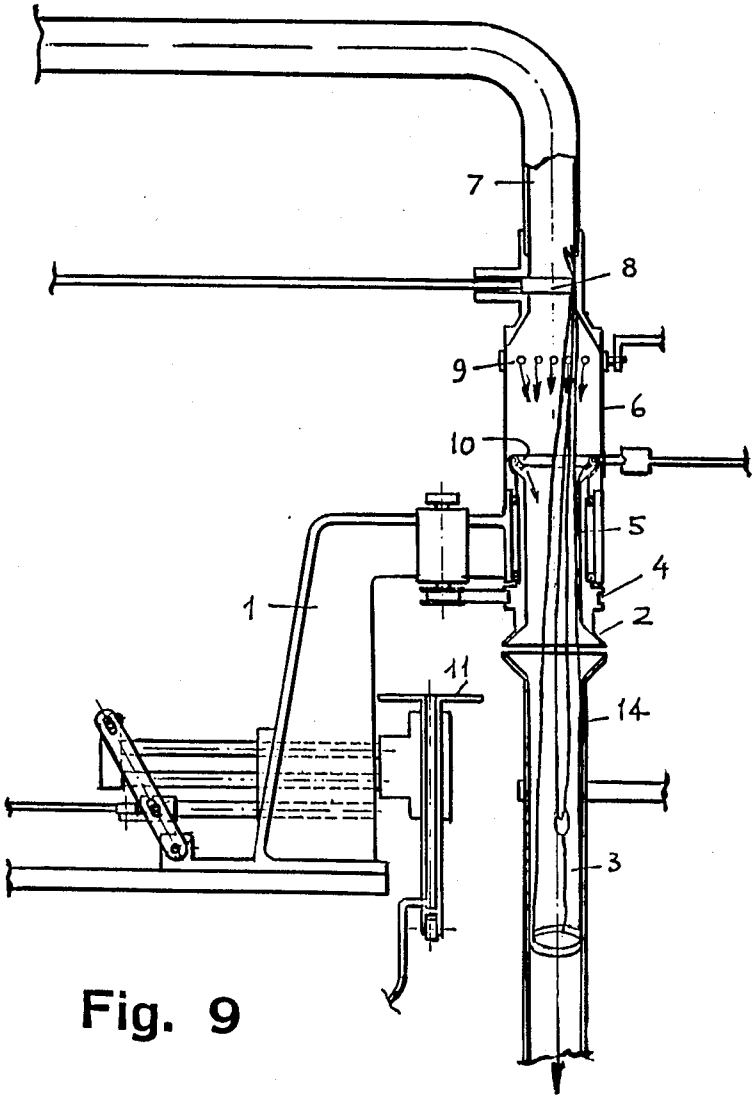
FIG. 9 is a section along FF of FIG. 1 showing the finished article after it has been turned right side out again.

The mode of operation is the following: During the standstill of an arm (1) of the carrousel in station (A) (FIG. 3), the edge of the unsewn crotch zone of a pantyhose (3) is laid by hand, while stretching it, on the lower edge of the support (2) in such a way that the article is in hanging position as illustrated in FIG. 3 of the annexed drawings. Then said arm is transferred to station (B) (FIG. 4) where, by pneumatic suction from duct (7), the body of the pantyhose introduces itself inside out into chamber (5), and the pantyhose legs, passing through the body, arrange themselves with the toe up in duct (7) and are held by the stop device (8). Subsequently arm (1) transfers to station (C) (FIG. 5) where plate (11), on which a patch (12) previously placed is held fixed by suction from below, rises coming up against and compressing the gusset (12) under the fabric of the article stretched on the support (2). In the next station (D) (FIG. 6) the support (2) is set in rotation while a cutting blade of the means (15) fixed in a position near the edge of the support (2) provides to trim the fabric of the patch and of the article outside the stitching line. Then arm (1) moves on to station (E) (FIG. 7) where the sewing machine performs the continuous sewing of the gusset to the article along the entire circumference of the support (2) maintained in rotation. Lastly, as soon as arm (1) has reached station (F) (FIGS. 8–10), by effect of the suction from below provided in duct (14) by the opening of the holes (9) and by the action of the compressed air issuing from the cocks (10), the zone of the ready-made article with the path is disengaged from the support (2), and while the article is still being retained by the toes due to the device (8), the body is formed to fall down, turning itself right side out; thereafter the article, let go by (8), is sucked through (14) in straight position.

In the practice the details of execution may vary in equivalent manner as to form, dimensions, arrangement of the elements, nature of the materials employed without going outside the scope of the idea of solution adopted and therefore remaining within the limits of portection granted by the present patent of invention.

I claim:

1. A machine for applying a gusset to a pantyhose comprising:

a carrousel type structure with a plurality of outwardly extending arms, said carrousel type structure dewlling at a plurality of stations, one station for each said outwardly extending arm;

a hollow support member carried on said arms;

operating stations disposed in the path of movement of said arms;

supporting means for supporting the pantyhose in stretched apart disposition over said support member to form a stretched out zone;

pneumatic inverting and drawing means for inverting the body of the pantyhose and drawing the legs thereof internally of said hollow support member with the legs disposed, stopped and held within said hollow support member;

horizontally moving securing means for retaining the legs of said pantyhose in a fixed position;

means for positioning and pressing a gusset to the stretched out zone of the pantyhose when held in the fixed position;

means for trimming the excess fabric from the gusset about the stretched out zone;

a sewing device disposed at one of said stations for sewing the gusset to the stretched out zone of the pantyhose;

pneumatic removal means for removing the pantyhose from the support and withdrawing the legs from said hollow support member; and means for releasing said securing means and means for reversing the pantyhose to its right side out position.

2. The machine of claim 1 wherein said support means comprises an inverted funnel-shaped element with a vertical axis, said funnel-shaped element having a lower horizontal edge shaped with a predetermined form and dimension to correspond to the size of the gusset to be applied to the pantyhose using this machine;

said support means further comprising a cylindrical guiding chamber, said chamber being integral with and extending upwardly from said support means; and, rotating means connected to said support means and operable for horizontally rotating said support means and said chamber.

3. The machine of claim 1 wherein each said outwardly extending arm is provided, at the bottom of said support, with a gusset-holding circular plate; said circular plate being operable to move vertically in the axis of said support and radially relative to the carrousel, thereby to hold and position gussets to be applied to the pantyhose article.

4. The machine of claim 1 wherein said trimming means comprises a cutting device operable to cut the fabric of the gusset and the stretched zone of the article which exceeds the seam line being formed by said sewing device, during a rotation of said support; and means provided for activating the movement of said cutting device toward and away from the edge of said support.

5. The machine of claim 1 wherein said sewing device comprises a sewing machine operable to sew superposed edges of the gusset and the stretched zone of the pantyhose article, when the pantyhose article is on said support, along the edge of said support and during one revolution of said support; and means provided for actuating the movement of said sewing machine toward and away from said support.

6. The machine of claim 1 wherein said removing means comprises a suction duct provided under and aligned with said support and adapted for transferring the finished article; and means provided for opening said inlet of said jacket, activating said cocks, and inactivating said stop device to remove the finished pantyhose article from the machine.

7. A machine for applying a gusset to a pantyhose comprising:

a carrousel type structure with a plurality of outwardly extending arms;

a hollow support member carried on said arms;

operating stations disposed in the path of movement of said arms;

means for supporting the pantyhose in stretched apart disposition over said support member;

means for inverting the body of the pantyhose with the legs disposed within said hollow support member;

means for positioning and pressing a gusset to the stretched out zone;

means for trimming the excess fabric from the gusset about the stretched out zone;

a sewing device disposed at one of said stations for sewing the gusset to the stretched out zone of the pantyhose;

means for removing the pantyhose from the support; and means for reversing the pantyhose to its right side out position;

each of said outwardly extending arms includes a jacket extending downwardly to and coaxially around the outside of said hollow support member, said jacket being provided with several holes and an obturating collar;

a suction duct provided in said arm in communication with said jacket;

a stopping device provided in said suction duct for stopping and holding the free ends of the pantyhose article in a position away from said support and above the position assumed by the reversed body for holding thereof in a predetermined position for sewing of the gusset to the stretched out zone; and inlet cocks disposed in said jacket and inclined toward the interior thereof, said cocks being operable to admit compressed air into said chamber.

8. The machine of claim 7 wherein:

said support means comprises an inverted funnel-shaped element with a vertical axis, said funnel-shaped element having a lower horizontal edge shaped with a predetermined form and dimension to correspond to the size of the gusset to be applied to the pantyhose using this machine;

said support means further comprising a cylindrical guiding chamber, said chamber being integral with and extending upwardly from said support means into said jacket; and rotating means connected to said support means and operable for horizontally rotating said support means and said chamber.

9. The machine of claim 7 wherein:

each said outwardly extending arm is provided, at the bottom of said support, with a gusset-holding circular plate, said circular plate being operable to move vertically in the axis of said support and radially relative to the carrousel, thereby to hold and position gussets to be applied to the pantyhose article.

10. The machine of claim 7 wherein said trimming means comprises a cutting device operable to cut the fabric of the gusset and the stretched zone of the article which exceeds the seam line being formed by said sewing device, during a rotation of said support; and means provided for activating the movement of said cutting device toward and away from the edge of said support.

11. The machine of claim 7 wherein said sewing device comprises a sewing machine operable to sew superimposed edges of the gusset and the stretched zone of the pantyhose article, when the pantyhose article is on said support, along the edge of said support and during one revolution of said support; and means provided for actuating the movement of said sewing machine toward and away from said support.

12. The machine of claim 7 wherein said removing means comprises a suction duct provided under and aligned with said support and adapted for transferring the finished article; and means provided for opening said inlet of said jacket, activating said cocks, and inactivating said stop device to remove the finished pantyhose article from the machine.

13. The machine of claim 1, wherein said inverting means includes suction means associated with said hollow support member for drawing the legs of the pantyhose internally of said hollow support member.

14. The machine of claim 1, wherein said inverting means includes stop means to hold the legs within said hollow support member after drawing the legs thereinto.

15. The machine of claim 1, wherein said reversing means includes openings in the wall of said hollow support member and downwardly inclined compressed air cocks within said hollow support member for supplying compressed air thereinto.

16. The machine of claim 1, wherein said removal means includes a suction duct positioned below said hollow support member for withdrawing the pantyhose from its disposition over said support member and compressed air cocks for admitting compressed air.

17. The machine of claim 7, wherein said support means includes a cylindrical guiding chamber integral with and extending upwardly from said support means into said jacket, and said inlet cocks are disposed in the top of said chamber and inclined toward the interior thereof.

18. The machine of claim 1 wherein said support means comprises an inverted funnel-shaped element with a vertical axis, said funnel-shaped element having a lower horizontal edge shaped with a predetermined form and dimension.

19. A machine for applying a gusset to pantyhose, comprising:

a carrousel type structure with a plurality of outwardly extending arms, said carrousel type structure dwelling at a plurality of stations, one station for each said outwardly extending arm;

a hollow support member carried on each said arm;

operating stations disposed in the path of movement of said arms;

supporting means for supporting the pantyhose in stretched apart disposition over said support member to form a stretched out zone;

inverting, drawing and stop means for inverting the body of the pantyhose and drawing the legs thereof internally of said hollow support member with the legs disposed, stopped and held within said hollow support member for holding the pantyhose and legs thereof in a fixed position;

said inverting and drawing means including a horizontally traversing stop device for holding the legs of the pantyhose internally of said hollow support member after the legs are drawn thereinto;

means for positioning and pressing a gusset to the stretched out zone of the pantyhose when held in a fixed position;

means for trimming the excess fabric from the gusset about the stretched out zone;

a sewing device disposed at one of said stations for sewing the gusset to the stretched out zone of the pantyhose;

removal means for removing the pantyhose from the support and withdrawing the legs from said hollow support member; and means for reversing the pantyhose to its right-side-out position.

20. The machine of claim 19, including means for rotating said hollow support member through an angle of 360° while said sewing device sews the gusset to the stretched out zone of the pantyhose.

21. A machine for fitting a gusset to tubular articles such as women's pantyhose after placing by hand a pair of pantyhose whose crotch zone is unstitched in a predetermined position relatively to a hollow support so that the unstitched edge of the fabric is stretched along a horizontal contour of a hoop member;

said machine comprising a carrousel having a plurality of arms each carrying a respective intermittently horizontally rotating support, with a number of stations and including at a respective one of the stations:

means for arranging said stitchless zone in a predetermined position relatively to the support;

means for turning the body of said pantyhose; over said support and introducing thereinto the legs of the pantyhose means for positioning and compressing the gusset juxtaposed on the support;

means for cutting the excess fabric of the gusset and stretched zone of the product beyond its stitching line;

means for stitching the overlapping edges of the gusset and said stretching zone;

means for removing the finished article with the gusset sewn to the pantyhose from the support;

means for straightening out the finished article; and means for conveying the finished article away from the support.

22. The machine according to claim 21, in which said support is an inverted funnel-shaped element whose access is vertical and whose horizontal bottom edge is of a shape and dimensions corresponding to those of the gusset to be fitted, and in which a respective cylindrical guide chamber is rigidly secured to each said support and extends from the top thereof, and means being provided to rotate the support and the guide chamber horizontally.

23. The machine according to claim 22, in which a respective sleeve or covering or the like is rigidly secured to each arm, the sleeve being coaxial of and outside the respective guide chamber and being connected at the top to a respective suction duct having means for securing the free ends of the legs in a position remote from the support and above the position of the turned-over body; each said sleeve being formed with a plurality of orifices and having a respective closure ring for closing said orifices and a plurality of compressed air nozzles being rigidly secured to each said sleeve inside thereof near the top of the respective guide chamber; and said nozzles being inclined downwardly towards the interior of said chamber.

24. The machine according to claim 21, in which each arm has, below its respective support, a respective gusset support plate which can move vertically along the axis of the respective support and can also move radially of said carrousel.

25. The machine according to claim 21, in which the cutting station comprises a cutting device which, during one revolution of the support, can cut the excess fabric of the gusset and said stretched zone beyond the stitching line, and known means for moving said cutting device towards and away from the support edge.

26. The machine according to claim 21, in which the stitching station comprises a known stitching machine for stitching the overlapping edges of the gusset to that zone of the article which is stretched on the support along the edge thereof and during one revolution thereof, and means being provided for moving the stitching machine towards and away from the support.

27. The machine according to claim 21, in which the station for releasing the pantyhose with attached gusset comprises a suction duct which is disposed below and axially of the support and provides direct conveyance thereof, and known means being provided to control the opening of the apertures in the sleeve, the operation of the nozzles and the release of the securing means.

28. The machine according to claim 21, comprising a carrousel having six arms performing in intermittent horizontal rotation where they dwell in all of said six stations, said stations including:

a first station for positioning a pantyhose with the edge of the stitchless zone thereof stretched;

a second station for turning said pantyhose over by pneumatic means;

a third station for positioning a gusset with its edge overlapping the stretched edge of said pantyhose;

a fourth station for cutting excess portions of the fabric of said pantyhose and gusset beyond the intended stitching line;

a fifth station for stitching said gusset to said pantyhose; and a sixth station for straightening and finished pantyhose with its gusset attached and for disengaging it by pneumatic means from a support.

* * * * *